United States Patent [19]

Nussbaumer

[11] Patent Number: 4,509,771

[45] Date of Patent: Apr. 9, 1985

[54] SKI

[75] Inventor: Wolfgang Nussbaumer, Dorkbirn, Austria

[73] Assignee: Kästle Gesellschaft m.b.H., Hohenems, Austria

[21] Appl. No.: 342,890

[22] Filed: Jan. 26, 1982

Related U.S. Application Data

[63] Continuation of Ser. No. 936,937, Aug. 25, 1978, abandoned, which is a continuation of Ser. No. 766,497, Feb. 7, 1977, abandoned.

[30] Foreign Application Priority Data

Feb. 13, 1976 [AT] Austria ..... 1051/76

[51] Int. Cl.[3] ..... A63C 5/04

[52] U.S. Cl. ..... 280/609; 280/608

[58] Field of Search ..... 280/608, 609, 604, 601; 9/310 R, 310 A, 310 B

[56] References Cited

U.S. PATENT DOCUMENTS

| | | | |
|---|---|---|---|
| 2,055,757 | 9/1936 | Tolman | 280/609 |

FOREIGN PATENT DOCUMENTS

| | | | |
|---|---|---|---|
| 182997 | 8/1955 | Austria | 280/609 |
| 60550 | 1/1943 | Denmark | 280/609 |
| 480399 | 8/1928 | Fed. Rep. of Germany | 280/609 |
| 855779 | 5/1940 | France | 280/609 |
| 376409 | 8/1959 | Switzerland | 280/609 |
| 503501 | 4/1971 | Switzerland | 280/609 |

*Primary Examiner*—Jeffrey V. Nase

*Attorney, Agent, or Firm*—Karl F. Ross; Herbert Dubno

[57] ABSTRACT

The running surface of an Alpine ski has a front portion adjoining its tip, a rear portion, and an intervening middle portion supporting a binding, the three portions differing from one another in their profiling designed to exert a minimum guiding effect in the middle portion and a maximum guiding effect in the rear portion. The latter, therefore, has one or more longitudinal grooves whose combined cross-sectional area exceeds that of the groove or grooves of the front portion whereas the middle portion is grooved only slightly or not at all.

4 Claims, 12 Drawing Figures

A
B
C
D
1
2
II
III
IV
VI
VII
VIII
α
β
1'
2'

SKI

CROSS-REFERENCE TO RELATED APPLICATIONS

This is a continuation of application Ser. No. 936,937 filed Aug. 25, 1978 as a continuation of application Ser. No. 766,497 filed Feb. 7, 1977, both now abandoned.

FIELD OF THE INVENTION

My present invention relates to a ski which has a running surface with longitudinal profiling designed to exert a certain guiding effect.

BACKGROUND OF THE INVENTION

The gliding characteristics of a ski are determined by a number of factors, i.e. by its bending resistance, its flexibility over the whole length of the ski, its torsional strength etc. Furthermore, the structure of the running surface—usually provided with one or more guiding grooves—has an essential influence on the guidance of the ski, i.e. on its directional stability as well as on its turnability.

Conventionally, a guiding groove starts in the portion next to the tip of the ski and extends longitudinally and with constant cross-section over the rest of its running surface, i.e. to its rear end; the groove generally has an arcuate or trapezoidal cross-section and may be either pressed into the running surface or milled out of it.

The number of such grooves and the shape of their cross-sections determine their guiding effect; thus, an increasing number of guiding grooves as well as an increase in their depth or in the flank angle of their cross-section improves the directional stability of the ski but impairs its turnability.

It has already been proposed to subdivide the running surface of the ski into several portions of different longitudinal profiling and consequently of different guiding effect. Swiss Pat. No. 161,592, for example, teaches that the central groove extending continuously over the front, middle and rear portions of the ski is to be flanked only in the middle portion by several additional smaller grooves designed to achieve good guidance when skiing straight downhill as well as good maneuverability on Christiania turns.

In the meantime, in the field of Alpine skiing, the conditions of the ski slopes have changed along with skiing technique and the structure of the ski has undergone an important development.

OBJECT OF THE INVENTION

It is, therefore, the object of my present invention to create a ski, particularly one of the so-called compact type used for Alpine skiing, whose running surface is designed to guarantee good turnability as well as high directional stability helping the user to keep on track.

SUMMARY OF THE INVENTION

I realize this object, in accordance with my present invention, by providing the underside of a ski with a continuous running surface which has mutually different longitudinally grooved profiles in a front and a rear portion of that surface while an intervening middle portion, serving to support a binding, is either substantially smooth or less profoundly grooved than the other two portions. The profile of the rear portion is more pronounced than that of the front portion for exerting a greater guiding effect upon the ski.

When the ski is being turned on a slope, the weight of the user rests mainly on the middle portion of its running surface which is grooved only to a relatively minor extent or not at all so that little resistance is encountered when the ski is swung about its center of gravity. On downhill coasting at higher speeds, however, the guiding effect of the rear portion comes into play.

As more particularly described hereinafter, the desired maneuverability combined with directional stability can be achieved by providing the rear portion of the running surface with one or more grooves whose combined cross-sectional area exceeds that of the grooving in the front portion. Thus, I may provide the rear portion with more grooves than the front portion and/or with at least one groove exceeding a corresponding front-portion groove in depth or in the slope of its flank angles.

The term "continuous running surface", as used above, is meant to distinguish over known types of runners whose undersurfaces are interrupted by one or more transverse recesses.

BRIEF DESCRIPTION OF THE DRAWING

The above and other features of my invention will now be described in detail with reference to the accompanying drawing in which.

SPECIFIC DESCRIPTION

Figures 1, 2, 3, 4, 5, 6, 7, 8:
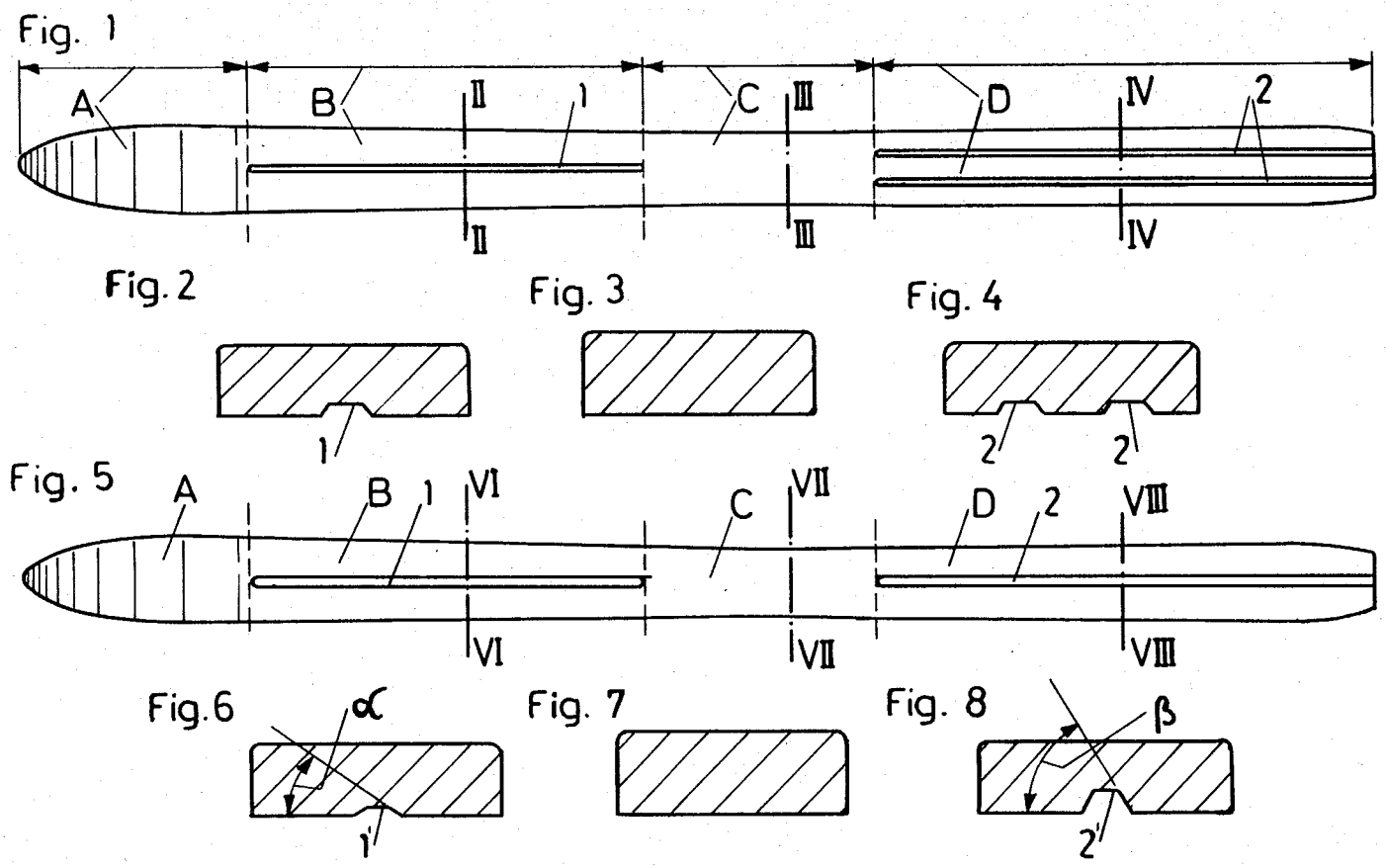
FIG. 1 represents a bottom view of a ski, showing its running surface.
FIG. 2 is a cross-sectional view taken along line II—II of FIG. 1.
FIG. 3 is a cross-sectional view taken along line III—III of FIG. 1.
FIG. 4 is a cross-sectional view taken along line IV—IV of FIG. 1.
FIG. 5 is a bottom view of another embodiment with a modified running surface.
FIG. 6 is a cross-sectional view taken along line VI—VI of FIG. 5.
FIG. 7 is a cross-sectional view taken along line VII—VII of FIG. 5.
FIG. 8 is a cross-sectional view taken along line VIII—VIII of FIG. 5.

The running surface of a ski according to FIGS. 1 to 4 is divided into four portions A, B, C, D. The tip portion A of the ski is conventional and has the usual smooth curved surface as shown in FIG. 1. A single guiding groove 1 of trapezoidal cross-section is centrally disposed in the front portion B of the running surface of the ski whereas two guiding grooves 2 of similar cross-section are arranged parallel to each other in the rear portion D. The grooves 2 are side-by-side and are transversely spaced as shown in FIG. 1. The guiding effect of these two grooves 2 in portion D is on the whole greater than that of the single groove 1 in portion B. The intervening middle portion C, which is below the ski binding (not shown), has no guiding groove at all.

In the embodiment of FIGS. 5 to 8 the running surface of the ski is also divided into four portions A, B, C, D. Once again, the tip portion A is smooth. The front portion B of the running surface is provided with one guiding groove 1' similar to groove of FIGS. 1 and 2. The rear portion D also only has but one guiding groove 2' of trapezoidal cross-section which, however, is deeper than the guiding groove 1' in portion B as can be seen from FIGS. 6 and 8. Furthermore, the flank angle $\beta$ of the guiding groove 2' is larger than the flank angle $\alpha$ of the guiding groove 1' as can also be seen from FIGS. 6 and 8. Thus, the guiding groove 2' in the rear portion D represents a longitudinal profiling with higher guiding effect. The middle portion C again has no guiding groove at all.

Figures 9, 10, 11, 12:
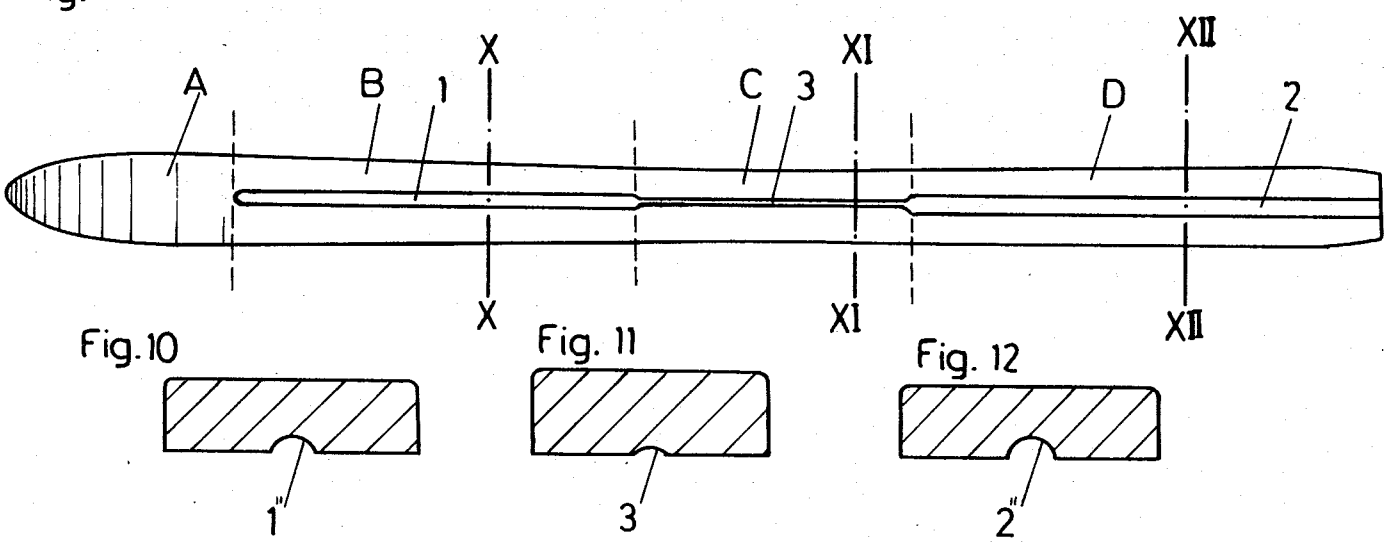
FIG. 9 is a bottom view of a further ski embodying my invention.
FIG. 10 is a cross-sectional view taken along line X—X of FIG. 9.
FIG. 11 is a cross-sectional view taken along line XI—XI of FIG. 9.
FIG. 12 is a cross-sectional view taken along line XII—XII of FIG. 9.

In the embodiment of FIGS. 9 to 12 the tip portion A is smooth, as before. Front portion B has a guiding groove 1'' whose arcuate cross-section, as seen in FIG. 11, is aligned therewith in the middle portion C. A single guiding groove 2'' of arcuate cross-section, as seen in FIG. 12, extends centrally along the entire rear portion D and is deepeer than groove 1''. All three guiding grooves 1'', 2'', 3 have, however, the same milling radius but their different depths result in different guiding effects; this effect is smallest in the middle portion C and largest in the rear portion D.

The profiles of the ski shown in FIGS. 2 to 4, 6 to 8 and 10 to 12 should only illustrate the shape and position of the guiding grooves. Therefore, no details are shown in regard to the mostly stratified structure of the runner body, its conventional steel edge, its upper surface and the usual coatings. For clarity's sake the dimensions of the guiding grooves in comparison with the body profile have been exaggerated in the cross-sectional views.

As will be apparent from the drawing, the overall cross-sectional area of the guiding groove or grooves of the running surface is smaller in the front portion B than in the rear portion D thereof; in the embodiment of FIGS. 9 to 12, where the middle portion C is also grooved, that cross-sectional area is still smaller than in the other two grooved portions.

The feature of the embodiment of FIGS. 1 to 4 (more guiding grooves in the back than in the front) can also be combined with those of the other embodiments (rear guiding grooves deeper or with steeper flanks than those in front).

I claim:

1. A ski having a front portion with a tip, a rear portion, and an intervening middle portion adapted to support a binding, said portions being provided with a continuous running surface which has mutually different grooved profiles in said front and rear portions and is substantially smooth and ungrooved in said middle portion, the profile of said front portion having only a single longitudinal groove, the profile of said rear portion having a plurality of side by side parallel longitudinal grooves for exerting a greater guiding effect upon the ski.

2. A ski as defined in claim 1 wherein said single longitudinal groove terminates short of said tip.

3. A ski as defined in claim 1 wherein the grooves of said front and rear portions are of substantially identical cross-section.

4. A ski as defined in claim 3 wherein said cross-section is trapezoidal.

* * * * *